United States Patent [19]

James et al.

[11] Patent Number: 4,553,668

[45] Date of Patent: Nov. 19, 1985

[54] PACKING ARTICLES, SUCH AS PACKAGES OF ROLLS OF PAPER

[75] Inventors: Robert C. James; Lloyd Kovacs, both of Sheboygan, Wis.

[73] Assignee: Hayssen Manufacturing Company, Sheboygan, Wis.

[21] Appl. No.: 495,976

[22] Filed: May 19, 1983

[51] Int. Cl.[4] ..... B65D 33/16

[52] U.S. Cl. ..... 206/391; 53/436; 53/527; 206/83.5; 229/43; 383/121

[58] Field of Search ..... 53/436, 466, 527; 206/83.5, 391, 410; 229/43; 383/56, 61, 62, 67, 71, 74, 78–80, 84, 93, 94, 98, 121, 125, 905

[56] References Cited

U.S. PATENT DOCUMENTS

| | | | |
|---|---|---|---|
| 1,363,196 | 12/1920 | Howard | 383/71 |
| 1,971,064 | 8/1934 | Corlette et al. | 383/121 |
| 2,402,476 | 6/1946 | Weeks | 53/436 |
| 2,441,513 | 5/1948 | Schmitt | 53/449 |
| 2,675,658 | 4/1954 | Crescenzo | 53/389 |
| 2,747,350 | 5/1956 | Cargill et al. | 53/527 |
| 2,817,474 | 12/1957 | Abramson | 383/121 |
| 2,853,225 | 9/1958 | Bauer | 383/121 |
| 3,195,801 | 7/1965 | Symons et al. | 383/126 |
| 3,645,822 | 2/1972 | Widiger et al. | 229/3.5 |
| 4,006,576 | 2/1977 | Tetenborg | 53/527 |
| 4,184,627 | 1/1980 | Achelpohl et al. | 383/121 |
| 4,235,366 | 11/1980 | Achelpohl et al. | 383/121 |
| 4,279,116 | 7/1981 | James et al. | 53/466 |

FOREIGN PATENT DOCUMENTS

| | | | |
|---|---|---|---|
| 2345499 | 4/1979 | Fed. Rep. of Germany | 206/497 |
| 2747897 | 5/1979 | Fed. Rep. of Germany | 53/527 |

*Primary Examiner*—George E. Lowrance
*Assistant Examiner*—Jimmy G. Foster
*Attorney, Agent, or Firm*—Senniger, Powers, Leavitt and Roedel

[57] ABSTRACT

A pack or bundle comprising a bag of thermoplastic film such as polyethylene, individual packages of rolls of paper, such as packages of four rolls of toilet tissue, packed in the bag, a closure panel inserted in the bag engaging the contents, the panel being heat-sealable on its outside face, the bag having a marginal lip at its mouth projecting beyond the closure panel folded over on the outside face of the closure panel and heat-sealed thereto to close the bag, and the method of making such bundles involving inserting the contents and the closure into the bag through its mouth, and folding over the lip and heat-sealing it to the panel.

22 Claims, 11 Drawing Figures

PACKING ARTICLES, SUCH AS PACKAGES OF ROLLS OF PAPER

BACKGROUND OF THE INVENTION

This invention relates to the packing or bundling of articles for storage and shipment, and more particularly to the packing or bundling of articles such as packages of rolls of paper, e.g., packages comprising four rolls of toilet tissue wrapped in plastic film, or rolls of paper toweling.

The assignee of this invention has for some years supplied to the paper industry in Europe machinery for accumulating a number of rolls of toilet tissue or household paper toweling and overwrapping the rolls in wrapper of polyethylene film, as an economic alternative to packing the rolls in cartons or cases of corrugated paperboard.

The stated overwrap method is not a viable method for the U.S.A., however, because U.S. producers of rolls of toilet tissue and paper toweling require that the wrapped bundle have an identical configuration to the existing corrugated case, that it be printed on all four sides, and that it be able to go through existing handling systems, including automatic palletizing and automatic warehousing and dewarehousing which require the use of optical scanners to read pre-printed pre-positioned codes. The U.S. carton configuration is substantially larger than that in Europe, and is close to being a cube. This has made modification of the assignee's existing overwrapping equipment to meet the requirements of the U.S. paper industry well-nigh impossible.

SUMMARY OF THE INVENTION

Among the several objects of this invention may be noted the provision of a mode of packaging rolls of paper in plastic film instead of in corrugated cases which meets the requirements of the U.S. paper industry; the provision of a package or bundle of rolls utilizing a plastic bag, e.g., a polyethylene bag, in which the rolls are tightly bundled; and the provision of such a package or bundle which is adapted for stacking of packages or bundles one on top of another, and which is slip-resistant for maintenance of the packages or bundles in stacks.

In general a package or bundle of this invention comprises a bag of flexible packaging material which is heat-sealable at least on the inside, product in the bag, a closure panel in the bag on the product at the mouth of the bag, the panel being heat-sealable at least on its outside face, the bag having marginal portion or lip at the bag mount all around the bag projecting beyond the panel and folded over on the outside face of the panel and heat sealed thereto. The method of the invention generally involves loading the bag with product through the mouth of the bag and inserting the closure panel with its other face on the inside and lying against the product and its heat-sealable face facing the outside and with said marginal portion or lip of the bag projecting beyond the panel, folding said marginal portion or lip over on the heat-sealable face of the panel and heat sealing it thereto.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
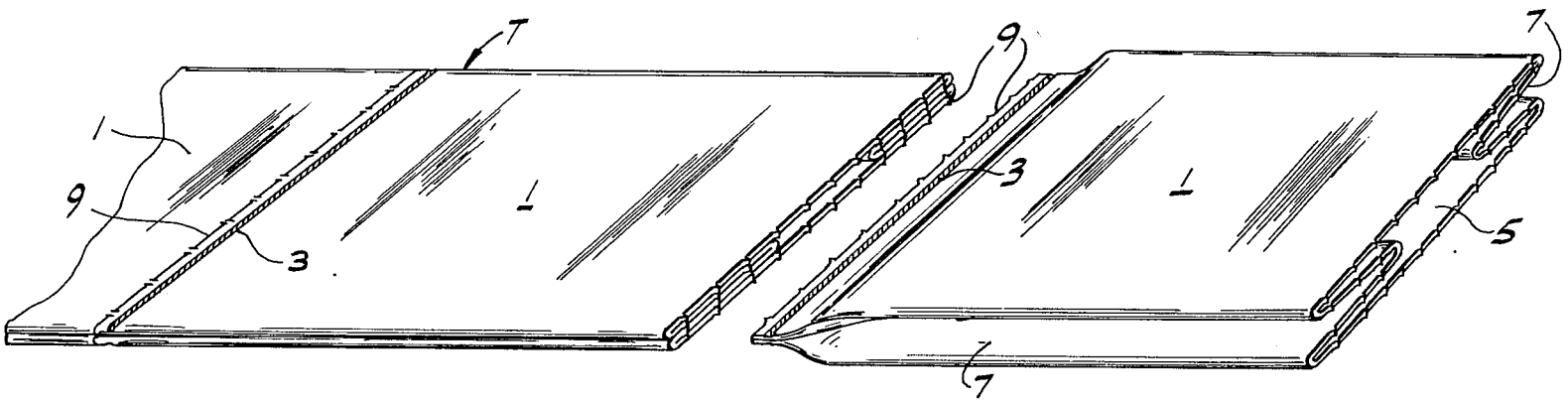
FIG. 1 is a view showing a bag used in the invention separated from a continuous series of bags.

Referring to the drawings, there is indicated at 1 a bag of flexible packaging material which is heat-sealable at least on the inside, and which in general is a polyethylene bag comprising a length of gussetted polyethylene tubing closed at one end constituting its bottom end by a heat seal as indicated at 3 extending completely across the bag and open at its other end constituting its mouth end 5. The gussets of the bag, which are indicated at 7, are relatively deep so that the bag, when packed as will appear, approaches the shape of a cube. It is contemplated that the bags will be supplied in a continuous series, formed by providing the bag bottom heat seals 3 across continuous gusseted polyethylene tubing T at bag length intervals (see FIG. 1), with lines of weakness 9, e.g., lines of perforations, extending transversely across the tubing adjacent each bag bottom heat seal 3 for tearing each bag away from the tubing, the open mouth of each bag occurring at the end of the torn-off bag opposite the heat-sealed bottom end.

Figure 2:
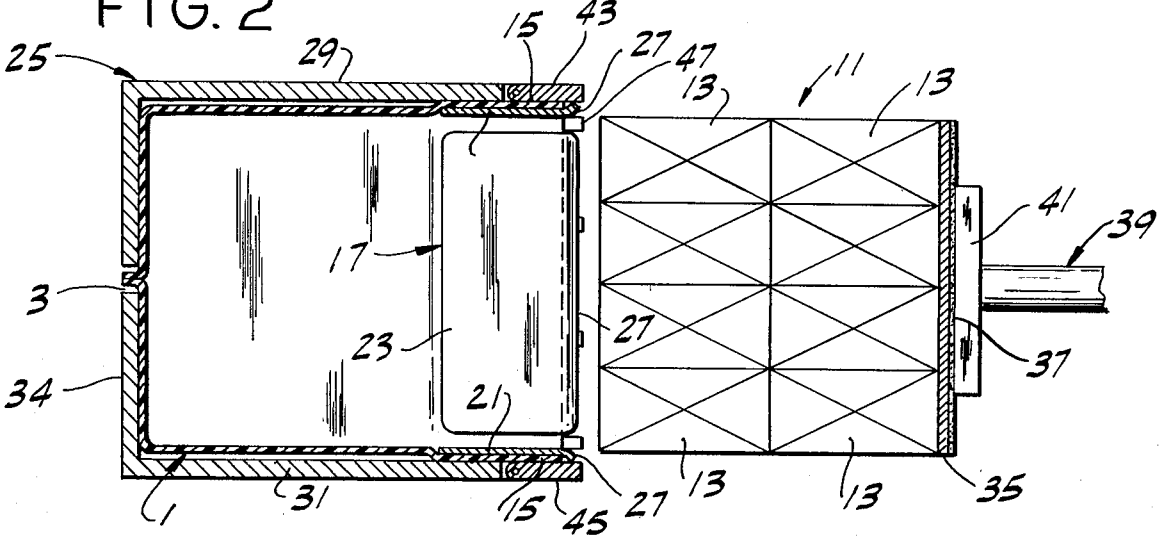
FIG. 2 is a view in section showing product comprising a collation of packages and an end closure panel in position for being entered in a bag through a horn which has spread the bag open at its mouth.
Figure 3:
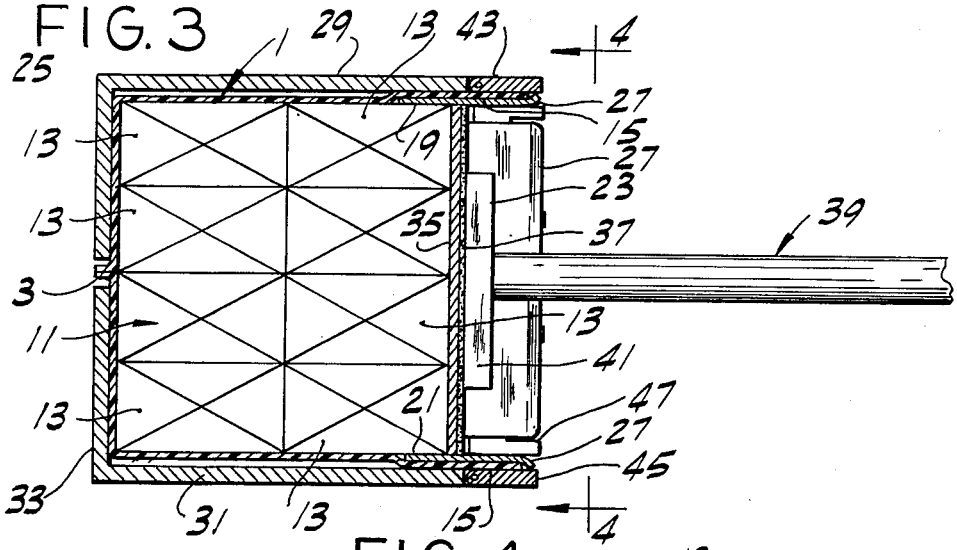
FIG. 3 is a view similar to FIG. 2 showing the packages and end closure panel entered in the bag.
Figure 4:
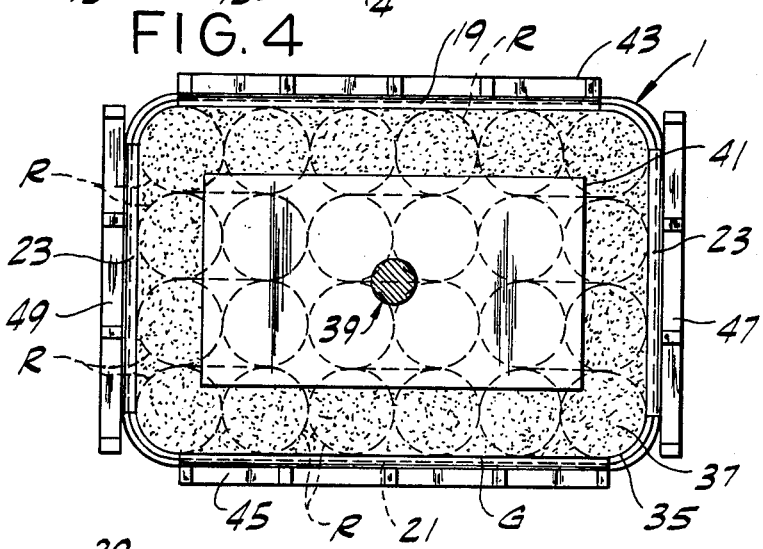
FIG. 4 is a view on line 4—4 of FIG. 3.

Product indicated generally at 11 in FIGS. 2–6 is packed in the bag in a manner to be described. As herein illustrated, the product 11 comprises a set or collation of twenty-four packages 13 of rolls R of toilet tissue, each of these twenty-four packages comprising four rolls of toilet tissue arranged in two side-by-side rows of two rolls each, with the two rolls in each row arranged end-to-end, the four rolls being wrapped in polyethylene. Such four-roll packages of toilet tissue, which are widely sold in the U.S.A., generally measure nine inches long, nine inches wide (at the widest) and four and one-half inches deep (each roll R generally being of four and one-half inch diameter and being four and one-half inches wide). The twenty-four packages are arranged as illustrated in FIGS. 2–5 in four layers, each layer comprising six packages arranged in three side-by-side rows with two packages arranged end-to-end in each row. Thus, the stack 11 of the twenty-four packages in section transverse to the bag is generally rectangular, and measures generally eighteen inches endwise, twenty-seven inches widthwise and eighteen inches heightwise. Its girth, indicated at G in FIG. 4, is generally eighty-five inches. The bag 1 has a girth corresponding to the girth of the stack for a tight fit of the stack in the bag, and has a length, (in its FIG. 1 unpacked condition) of about thirty inches, which provides for a marginal portion or lip 15 of the bag at the bag mouth projecting about three inches beyond the end of the stack at the bag mouth when the stack is fully inserted in the bag.

Referring to FIG. 2, the bag 1 is shown as having been opened for loading the stack 11 of packages 13 in the bag by applying the mouth end 5 of the bag to means indicated generally at 17 for spreading the bag open at its mouth and gripping it to enable pushing or ramming the stack into the bag. As illustrated, this means 17 includes an expansible and contractible horn comprising top and bottom plates or platens 19 and 21 and side plates or platens each designated 23 adapted to be moved between a contracted position for slipping the bag over the platens and an expanded position for spreading the bag open at its mouth, and a surrounding rectangular frame structure generally designated 25 against which the bag is gripped by the expanded horn platens. The horn platens, when expanded, may stretch the bag slightly thereby fully to open it, and may have flared entrance edges as indicated at 27 to guide the stack into the bag. The frame structure 25 is shown as having a top 29, a bottom 31, sides each designated 33 and an end 34, the latter being engageable by the bottom of the bag when the stack is inserted in the bag.

With the bag applied to the horn platens 19, 21, 23 and with these platens spread outwardly and gripping the bag against the top 29, bottom 31 and sides 33 of the frame structure 25, the stack 11 of packages 13 together with a closure panel 35 are inserted in the bag through the spread-open mouth 5 of the bag. As shown, the closure panel comprises a piece of relatively thin sheet material, such as heavy paper (40–80 pounds per ream) or linerboard (100–140 pounds per ream) having generally the same shape as the shape of the end of the stack, i.e., generally rectangular with arcuate corners, and measuring about twenty-seven inches wide and eighteen inches high for the stack of twenty-four package as herein described, with a coating 37 of heat-sealable material, e.g., polyethylene, compatible for sealing with the material (polyethylene) of the bag, on one face of the panel constituting its outside face. The closure panel is applied flat against the outer end of the stack with its heat-sealable face 37 on the outside, and the stack and the panel are pushed or rammed into the bag through the loading horn arrangement formed by the platens 19, 21, 23 to the point where the leading end of the stack engages and spreads out the bottom of the bag, and the trailing end of the stack with the closure panel 35 flat against it are spaced inwardly from the mouth end of the bag the distance, e.g., three inches, provided for by use of a bag long enough for this purpose relative to the length of the stack. With the closure panel 35 thus spaced inwardly from the mouth end of the bag, the bag has the marginal portion or lip at its mouth as indicated at 15 projecting beyond the panel as shown in FIG. 3.

The stack 11 and panel 35 are pushed into the bag 1 by means of a ram 39 having a head 41 of sufficiently smaller outline than the panel 35 to allow the top portion 15*a*, the bottom portion 15*b* and the side portions 15*c* of the lip 15 of the bag to be folded over into face-to-face engagement with the outside heat-sealable face 37 of the closure panel. Thus, for example, the head 41 of the ram may be of rectuangular form measuring about twenty inches wide and eleven inches high, allowing about three and one-half inches all around the head for the folding over of the three inch top, bottom and side portions 15*a*, 15*b*, 15*c* of the projecting three-inch lip 15 of the bag.

To facilitate the bag loading operation, the bag may be expanded by blowing air into it. As the stack is pushed into the bag, with the bag spread and gripped by the horn platens 19, 21 and 23 at its mouth, the stack expands the bag to some extent so that the stack is tightly confined in the bag. The stack engages the bottom of the bag which in turn engages the end 34 of the frame structure 25 for some compression of the stack by the head 41 of the ram against the end 34 of the frame structure.

Figure 5:
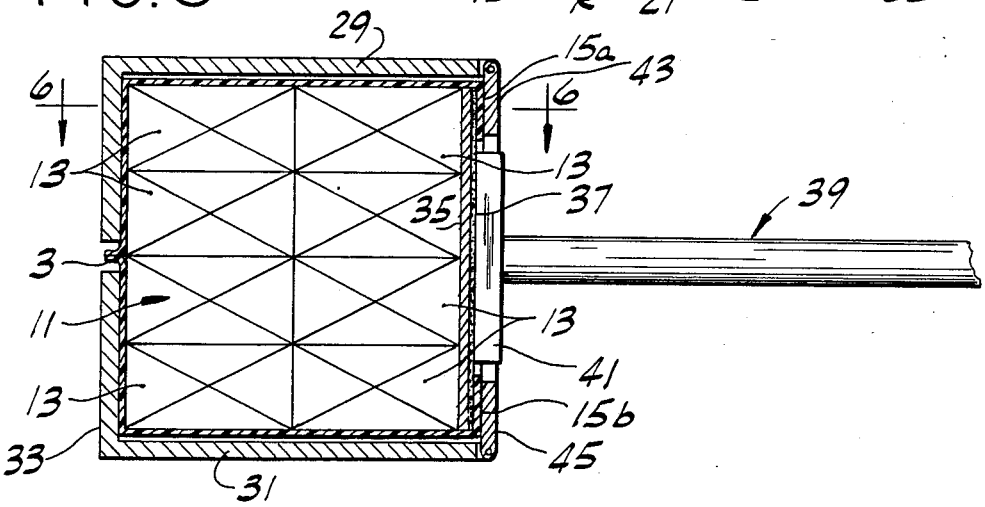
FIG. 5 is a view similar to FIG. 3 showing the horn withdrawn from within the bag and a marginal portion or lip of the bag at its mouth projecting beyond the end closure panel folded over on the outside face of the panel, this view also being generally in section on line 5—5 of FIG. 7.
Figure 6:
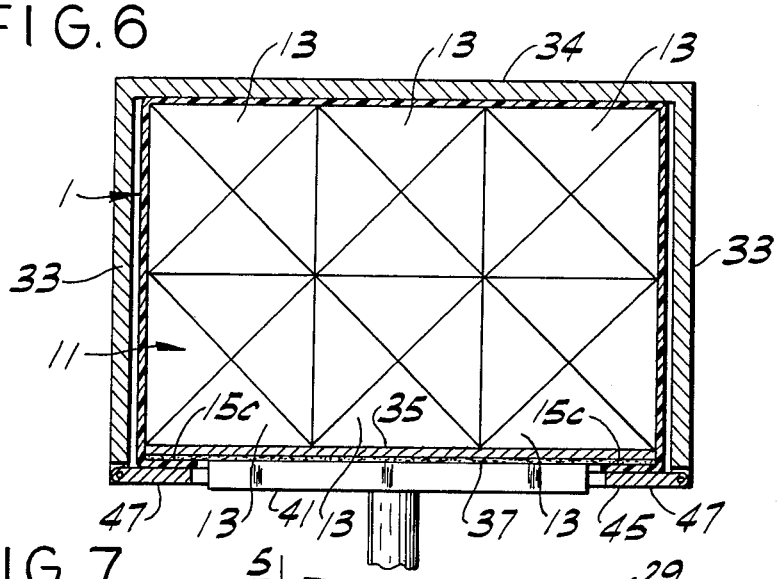
FIG. 6 is a view in section on line 6—6 of FIG. 5.
Figure 7:
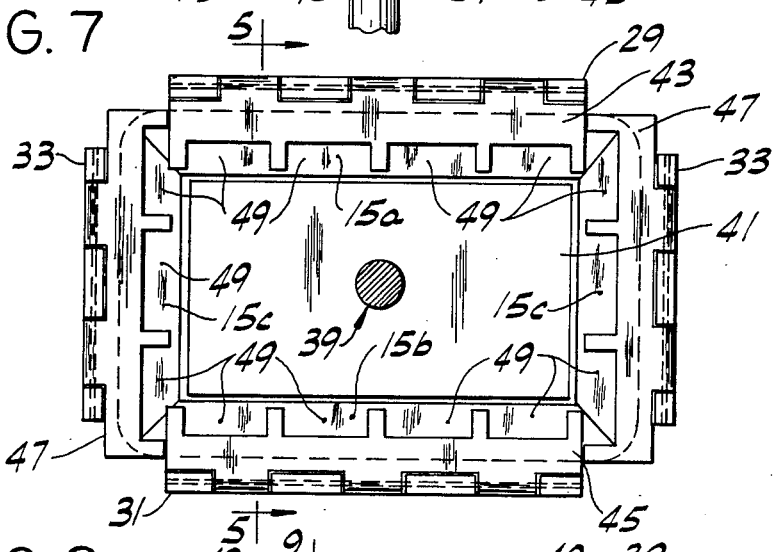
FIG. 7 is a view similar to FIG. 4, showing the folding over of the marginal portion or lip of the bag at the bag mouth on the outside of the end closure panel.
Figure 8:
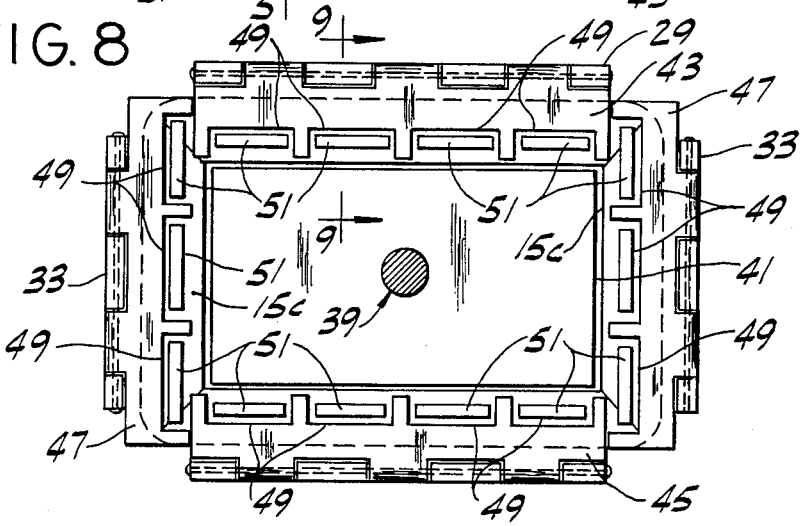
FIG. 8 is a view similar to FIG. 7 showing the folded-over marginal portion or lip of the bag being heat-sealed at intervals to the outside face of the end closure panel.
Figure 9:
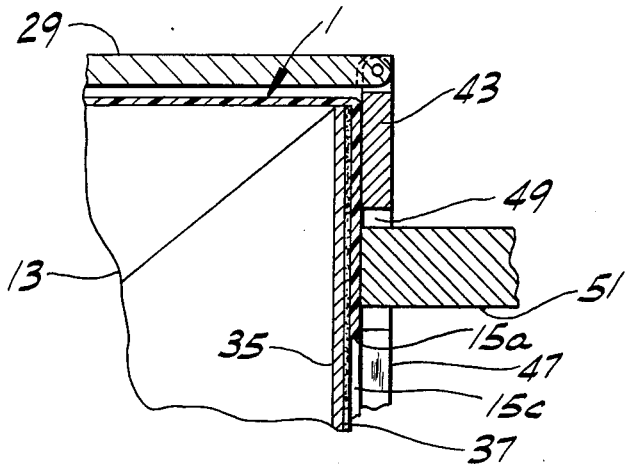
FIG. 9 is an enlarged section on line 9—9 of FIG. 8.

While maintaining the ram head 41 pressing against the end closure panel 35 and maintaining the stack under some compression in the bag, as illustrated in FIG. 5, the horn platens 19, 21, 23 are withdrawn from within the bag to allow the portion of the bag which had been spread out by the horn platens to contract into engagement with the stack (and the peripheral edge of the end closure panel 35) and to allow for the folding over of the top, bottom and side portions 15*a*, 15*b*, 15*c* of the projecting three-inch lip 15 of the bag at its mouth. These marginal portions or flaps 15*a*, 15*b*, 15*c* are then folded over around the top, bottom and side edges of the closure panel 35 into face-to-face engagement with its outside heat-sealable face 37. The folding is by means of folding members at the top, bottom and sides of the mouth end of the frame structure 25, these members being illustrated as bars pivoted at the mouth ends of the top, bottom and sides 29, 31 and 33 of the frame structure 25, the top folding bar being designated 43, the bottom folding bar being designated 45 and each of the side folding bars being designated 47.

Figure 10:
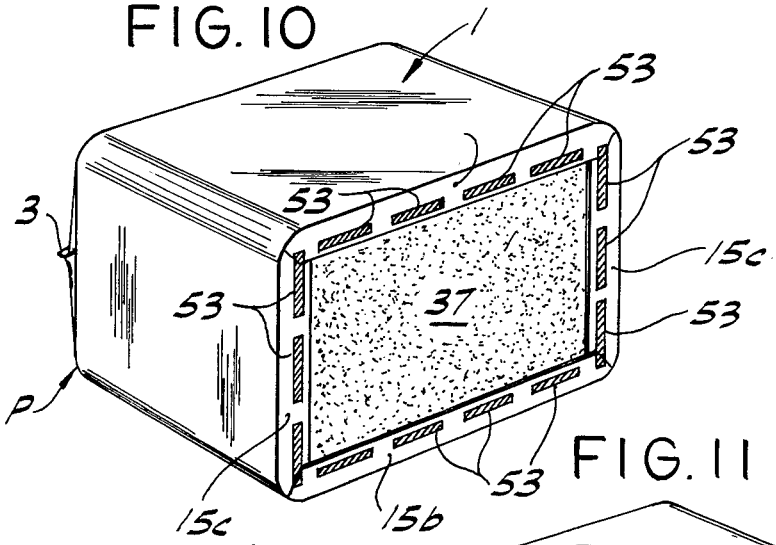
FIG. 10 is a perspective of the package or bundle comprising the bag, product and end closure panel with the stated marginal portion or lip of the bag folded over on and heat-sealed at intervals to the panel.

Each of the folding bars 43, 45 and 47 is formed with notches as indicated at 49 for entry of heated sealing members designated 51 for pressing the folded-over margins or flaps 15*a*, 15*b*, 15*c* of the bag against the heat-sealable outside face 37 of the end closure panel and heat-sealing the margins thereto at spaced intervals around the panel 35 adjacent its periphery. The sealing is in the nature of spot sealing, the sealing members 51 being shaped to form elongate spots 53 (e.g., four inches long and an inch wide). The sealing is carried out with the ram head 41 pressing against the end closure panel 35 and maintaining the product 11 in the bag under some compression, whereby the closure of the bag by the sealed-in-place end closure panel is completed to form the package indicated at P in FIG. 10 with the product tightly encompassed by the bag and the end closure. The package P, comprising the bag, product and end closure panel, may also be referred to as a bundle or bale; the bag may be referred to as a baler bag.

Figure 11:
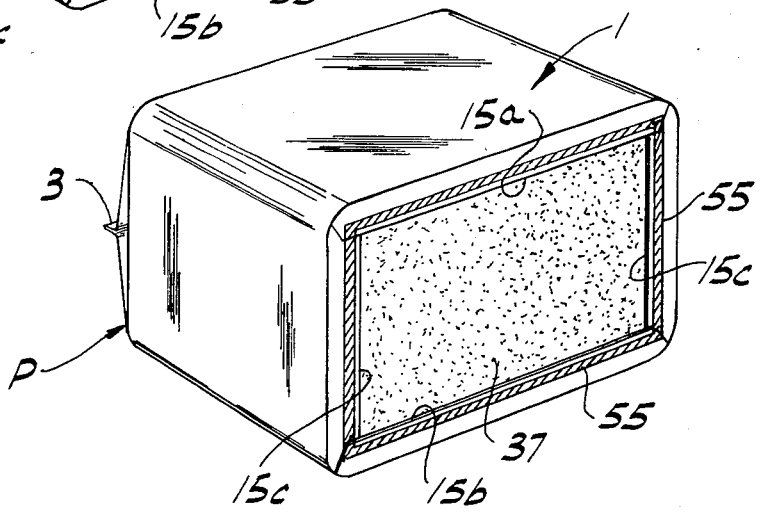
FIG. 11 is a view similar to FIG. 10 showing the sealing completed to be continuous all around the folded-over marginal portion or lip.

Following the spot sealing operation, the spot sealing members 51 are withdrawn, the folding bars 43, 45 and 47 are retracted, the ram head 41 is retracted, and the package, bundle or bale P completed to the point where the margins 15*a*, 15*b*, 15*c* of the bag at the mouth of the bag are folded over and heat-sealed to the heat-sealable outside face 37 of the end closure panel by the spot seals 53 is removed from the frame structure 25. The discontinuous seal formed by the spot seals 53 may then be made continuous throughout the folded-over margins or flaps 15*a*, 15*b*, 15*c* as shown in FIG. 11, where the continuous seal is designated 55, in a separate heat-sealing operation, thereby completely to seal the package P to protect its contents.

The coating 37 on the outside face of the end closure panel 35 may cover the outside face comletely and may be made such as to have anti-slip characteristics (e.g., made somewhat rough) so that bundles stacked one on another with the non-slip coating 37 of the panel 35 of one bundle engaging another bundle will resist slipping relative to one another. It is also contemplated that, if desirable, the coating 37 may be made with a slip characteristic so that bundles may slide easily relative to one another. If neither of these characteristics is wanted, the coating need not cover the entire face of the end panel 35, but may be limited to a band around the panel adjacent its periphery. It will be observed that the product height is such in relation to the length of the bag that, with the closure panel on the product, the lip 15 at any point around the bag is of relatively narrow width substantially less than half the distance across the panel from said point. The lip is folded over around the edge of the panel on the outside of the panel and, being narrow, leaves a substantial portion of the panel exposed within the lip.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A package comprising:

a bag of flexible packaging material which is heat-sealable at least on the inside;

said bag being formed with a first end closure at one end and an open mouth at its other end;

product in the bag of generally rectangular shape in section transverse to the bag and of generally rectangular shape in section lengthwise of the bag thereby having four generally rectangular sides and first and second generally rectangular ends;

said first end closure of the bag being such as to enable opening up of the bag with portions of said flexible packaging material of the bag at said first end closure of generally rectangular shape corresponding to the shape of said first end of said product;

said product being packed in the bag with its said first end at said first end closure of the bag with said portions of said material of the bag at its said first end closure of generally rectangular shape corresponding to the shape of said first end of said product and generally flat at said first end of said product, and with the bag generally tight girthwise around said four generally rectangular sides of said product;

the height of the bag being such in relation to the height of the product that, with the bag at its said first end closure of generally rectangular shape and generally flat at said first end of said product, the bag has a lip all around the bag at the mouth of the bag projecting beyond said sides of said product;

a flat closure panel inserted in the bag on said second end of said product;

said closure panel being generally rectangular in shape corresponding generally in shape to said second end of said product and having edges adjacent the edges of said second end of said product;

said closure panel being heat-sealable compatibly with the bag at least around the margin thereof on the ouside for heat sealing of said lip of the bag to said margin;

said lip providing four marginal portions of the bag at the mouth of the bag constituting flaps at each of the four edges of the closure panel;

each flap at any point thereof being of relatively narrow width substantially less than half the distance across the panel from said point;

said flaps being folded over on the outside of said closure panel overlying the closure panel all around the margin thereof and being heat-sealed to said margin thereby forming a second end closure, with a substantial portion of the panel exposed within said flaps.

2. A package as set forth in claim 1 wherein the bag is a bag of heat-sealable plastic film and the closure panel comprises a piece of non-heat-sealable material having a coating of heat-sealable plastic on its outside face.

3. A package as set forth in claim 2 wherein the product comprises a plurality of individual paper items which are per se compressible, said items being assembled in a stack having said four generally rectangular sides and first and second generally rectangular ends with the items so arranged that the stack is compressible girthwise.

4. A package as set forth in claim 3 wherein the paper items are rolls of paper assembled in said stack with the axes of the rolls extending lengthwise of the bag.

5. A package as set forth in claim 4 wherein the rolls of paper are toilet tissue rolls in individual packages within the bag, each individual package comprising a plurality of the rolls wrapped in a heat-sealable wrapper, said panel in comprising a piece of non-heat-sealable material with the heat-sealable plastic coating on its outside face allowing the heat-sealing of the flaps to the panel without sealing to the roll wrappers.

6. A package as set forth in claim 2 wherein the plastic coating generally completely covers the outside face of the panel and has a non-slip characteristic for non-slip of packages in a stack.

7. A package as set forth in claim 2 wherein the plastic coating generally completely covers the outside face of the panel and has a slip characteristic for facilitating sliding of the package.

8. A package as set forth in claim 1 wherein the bag comprises a length of gussetted tubing of heat-sealable plastic, and said first end closure is formed by a heat seal extending across the bag.

9. A package as set forth in claim 8 wherein the closure panel comprises a piece of non-heat-sealable material having a coating of heat-sealable plastic on its outside face.

10. A package as set forth in claim 9 wherein the product comprises a plurality of individual paper items which are per se compressible, said items being assembled in a stack having said four generally rectangular sides and first and second generally rectangular ends with the items so arranged that the stack is compressible girthwise.

11. A package as set forth in claim 10 wherein the paper items are rolls of paper assembled in said stack with the axes of the rolls extending lengthwise of bag.

12. A package as set forth in claim 11 wherein the rolls of paper are toilet tissue rolls in individual packages within the bag, each individual package comprising a plurality of the rolls wrapped in a heat-sealable wrapper, said panel in comprising a piece of non-heat-sealable material with the heat-sealable plastic coating on its outside face allowing the heat-sealing of the flaps to the panel without sealing to the roll wrappers.

13. A package as set forth in claim 9 wherein the plastic coating generally completely covers the outside face of the panel and has a non-slip characteristic for non-slip of packages in a stack.

14. A package as set forth in claim 9 wherein the plastic coating generally completely covers the outside face of the panel and has a slip characteristic for facilitating sliding of the package.

15. The method of packaging utilizing a bag of flexible packaging material which is heat-sealable at least on the inside and which is formed with a first end closure at one end and an open mouth at its other end, said method comprising:

loading the bag with product through the mouth of the bag;

said product being of generally rectangular shape in section transverse to the bag and of generally rectangular shape in section heightwise of the bag thereby having four generally rectangular sides and first and second generally rectangular ends;

said first end closure of the bag being such as to enable opening up of the bag with portions of said flexible packaging material of the bag at said first end closure of generally rectangular shape corresponding to the shape of said first end of said product;

the product being loaded in the bag with its said first end first and at said first end closure of the bag with portions of the material of the bag at its said first end closure of generally rectangular shape corresponding to the shape of said first end of said product and generally flat at said first end of said product;

the girth of the bag and the girth of the product being such and the product being so loaded in the bag that the bag is generally tight girthwise around said four generally rectangular sides of said product;

the height of the bag and the height of the product being such that, with the bag at its said first end closure of generally rectangular shape and generally flat at said first end of said product, the bag has a lip all around the bag at the mouth of the bag projecting beyond said sides of said product;

inserting a flat closure panel in the bag to lie against said second end of the product;

said closure panel being generally rectangular in shape corresponding generally in shape to said second end of said product and having edges adjacent the edges of said second end of said product;

said closure panel being heat-sealable compatibly with the bag at least around the margin thereof on the outside for heat sealing of said lip of the bag to said margin;

said lip providing four marginal portions of the bag at the mouth of the bag constituting flaps at each of the four edges of the closure panel;

each flap at any point thereof being of relatively narrow width substantially less than half the distance across the panel from said point; and folding said flaps over on the outside of said closure panel so that they overlie the closure panel all around the margin thereof and heat-sealing said flaps to said margin to form a second end closure, with a substantial portion of the panel exposed within said flaps.

16. The method of claim 15 wherein the bag is a bag of heat-sealable plastic film, said closure panel is a piece of non-heat-sealable material having a coating of heat-sealable material on one face, said closure panel is inserted in the bag with said coated face thereof toward the outside, and said flaps are folded over on and heat-sealed to the margin of said coated face.

17. The method of claim 1 wherein the product comprises a plurality of paper items which are per se compressible, said items being assembled in a stack having said four generally rectangular sides and first and second generally rectangular ends with the items so arranged that the stack is compressible girthwise, and the stack is loaded as a unit in the bag.

18. The method of claim 17 wherein, for the loading, the bag is spread open, and the stack is pushed as a unit into the bag under conditions such that the stack is compressed girthwise.

19. The method of claim 18 wherein the paper items are rolls of paper, said rolls being assembled in the stack with the axes of the rolls extending lengthwise of the bag.

20. The mehtod of claim 19 wherein the rolls of paper are toilet tissue rolls in individual packages, each package comprising a plurality of the rolls wrapped in a heat-sealable wrapper, said individual packages being assembled in the stack with the axes of the rolls in the packages extending lengthwise of the bag.

21. The method of claim 18 wherein the bags are supplied as a continuous series of gusseted tubing of heat-sealable plastic having heat seals extending across the tubing at bag length intervals forming said first end closure for each bag with lines of weakness extending across the tubing adjacent each said first end closure seal, each bag being separated from the tubing by separation at a line of weakness.

22. The method of packaging comprising loading a bag of flexible packaging material with product through the mouth of the bag and inserting a closure panel through the mouth of the bag with the inside of the closure panel lying against the product, the product height being such that, with the closure panel on the product, the bag has a lip all around the bag projecting beyond said panel at the mouth of the bag, the lip at any point around the bag being of relatively narrow width substantially less than half the distance across the panel from said point, the lip on the inside thereof and the margin of the panel on the outside thereof being of compatible sealing material, folding over the lip on the outside of the panel, the lip extending all around the margin of the panel on the outside of the panel with a substantial portion of the panel exposed within the lip, and sealing the lip to the margin of the panel on the outside of the panel, the bag being a heat-sealable plastic bag and the closure panel being compatibly heat-sealable on the outside face thereof with the plastic of the bag, the lip of the bag being heat-sealed to the outisde face of the panel, the bag being spread open at its mouth, and the product and the end closure panel being simultaneously pushed into the bag through its mouth and the product thereby compressed, compression being maintained while the lip of the bag is folded over on the outside face of the panel and heat-sealed to the coating on said face, the product in section transverse to the bag and the panel being generally rectangular, the product and bag being dimensioned for a relatively tight fit of the product in the bag, the lip comprising four marginal portions of the bag which are folded over around the four sides of the panel on the outside face of the panel, and each of the four marginal portions being heat-sealed to the outside face of the panel, said four marginal portions being heat-sealed to the panel at intervals while compression is maintained, the folding over of the marginal portions being effected by folding members having gaps therein and the heat sealing being effected by entering heat sealing members in the gaps.

* * * * *

UNITED STATES PATENT AND TRADEMARK OFFICE

CERTIFICATE OF CORRECTION

PATENT NO. : 4,553,668

DATED : November 19, 1985

INVENTOR(S) : Robert C. James and Lloyd Kovacs

It is certified that error appears in the above—identified patent and that said Letters Patent is hereby corrected as shown below:

Column 1, line 54, "marginal" should read -- a marginal --. Column 1, line 55, "mount" should read -- mouth --. Column 3, line 53, "package" should read -- packages --. Column 7, claim 11, line 3, "of bag" should read -- of the bag --. Column 8, claim 17, line 1, "claim 1" should read -- claim 16 --.

Signed and Sealed this

*Twenty-third* Day of *September 1986*

[SEAL]

*Attest:*

DONALD J. QUIGG

*Attesting Officer*

*Commissioner of Patents and Trademarks*